US010870041B2

(12) United States Patent
Tsunashima et al.

(10) Patent No.: US 10,870,041 B2
(45) Date of Patent: Dec. 22, 2020

(54) GOLF CLUB HEAD WITH DEFORMATION PORTION

(71) Applicant: Sumitomo Rubber Industries, Ltd., Hyogo (JP)

(72) Inventors: Hiromasa Tsunashima, Kobe (JP); Masahide Onuki, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 16/426,652

(22) Filed: May 30, 2019

(65) Prior Publication Data

US 2019/0374823 A1 Dec. 12, 2019

(30) Foreign Application Priority Data

Jun. 6, 2018 (JP) ..... 2018-108288

(51) Int. Cl.
*A63B 53/04* (2015.01)

(52) U.S. Cl.
CPC ..... *A63B 53/0466* (2013.01); *A63B 53/0408* (2020.08); *A63B 53/0445* (2020.08)

(58) Field of Classification Search
CPC ..... A63B 53/0466; A63B 53/0408; A63B 53/0445
See application file for complete search history.

(56) References Cited

U.S. PATENT DOCUMENTS 7,228,637 B2 * 6/2007 Kim ..... G01C 9/28 33/365
7,500,924 B2 * 3/2009 Yokota ..... A63B 53/0466 473/332
8,435,134 B2 * 5/2013 Tang ..... A63B 53/04 473/329
8,986,133 B2 * 3/2015 Bennett ..... A63B 53/0466 473/329
9,770,633 B2 * 9/2017 Fossum ..... A63B 53/0466
2002/0183134 A1 * 12/2002 Allen ..... A63B 53/04 473/329
2004/0192463 A1 * 9/2004 Tsurumaki ..... A63B 53/0466 473/329
2015/0045140 A1 * 2/2015 Fossum ..... A63B 53/0466 473/329
2015/0238826 A1 * 8/2015 Llewellyn ..... A63B 53/0466 473/332
2016/0325155 A1 * 11/2016 Llewellyn ..... A63B 53/0466
2020/0038723 A1 * 2/2020 Llewellyn ..... A63B 53/0466

FOREIGN PATENT DOCUMENTS

JP 2016-182356 A 10/2016

* cited by examiner

*Primary Examiner* — William M Pierce
(74) *Attorney, Agent, or Firm* — Studebaker & Brackett PC

(57) ABSTRACT

A hollow golf club head comprises a face portion having a club face for hitting a ball, and a main body portion including a crown wall, a side wall and a sole wall which extend from the face portion toward the rear of the head. At least one of the walls of the main body portion is provided with a folded portion for facilitating a partial elastic deformation of the main body portion when the face portion hits a ball. The folded portion includes a first folded portion and a second folded portion each extending in the front-back direction of the head while swinging in the thickness direction of the wall. The first folded portion and the second folded portion are continuous with each other and extend along the peripheral edge of the club face, and have different phases in the swing.

8 Claims, 15 Drawing Sheets s1 section

A–A

B–B

GOLF CLUB HEAD WITH DEFORMATION PORTION

TECHNICAL FIELD

The present invention relates to a golf club head, more particularly to a hollow golf club head.

BACKGROUND ART

Heretofore, various attempts have been made to improve the rebound performance of a golf club head in order to increase the flight distance of a hit ball.

For example, Patent Document 1 below describes that a sole portion of a golf club head is provided with a folded portion extending in the toe-heel direction in substantially parallel to the leading edge of the head.

Patent Document 1: Japanese Patent Application Publication No. 2016-182356

SUMMARY OF THE INVENTION

Problems to be Solved by the Invention

The present inventors found out that it is possible to significantly improve the rebound performance of a golf club head by forming a novel folded structure in at least a part of the main body portion of the head comprising a crown wall, a side wall and a sole wall which walls extend from the face portion of the head toward the rear of the head.

It is therefore, an object of the present invention to provide a golf club head which can help to increase the flight distance of a hit ball.

According to one aspect of the present invention, a hollow golf club head comprises:

a face portion having a face for striking a ball; and a main body portion including a crown wall, a side wall and a sole wall which walls extend from the face portion toward the rear of the head, wherein at least one wall of the crown wall, the side wall and the sole wall is provided with a folded portion for facilitating a partial elastic deformation of the main body portion when the face portion hits a ball, the folded portion includes a first folded portion and a second folded portion, each of the first folded portion and the second folded portion extends in a font-back direction of the head while swinging in the thickness direction of the wall, the first folded portion and the second folded portion are continuous with each other and extends along the peripheral edge of the face portion, and the phase of the swing of the first folded portion is different from the phase of the swing of the second folded portion.

In the golf club head according to the present invention, the folded portion is formed such that the first folded portions and the second folded portions having different phases are continuous along the peripheral edge of the face portion. Such folded portion effectively reduces the rigidity of the wall in the ball hitting direction. Therefore, the main body portion exhibits a large amount of elastic deformation at the time of hitting the ball, and the golf club head according to the present invention can exhibit high rebound performance. Thus, the golf club head of the present invention can increases the flight distance of the hit ball.

The difference in the phase of the swing between the first folded portion and the second folded portion may be a half cycle.

The folded portion may be formed so as to extend across at least two adjacent walls of the crown wall, the side wall and the sole wall. In this case, the junction at which the first folded portion is connected to the second folded portion may be formed at a position corresponding to that of the boundary between the two adjacent walls.

The junction may extend in a zigzag shape in the front-back direction of the head.

Each of the first folded portion and the second folded portion may have a valley recessed toward the inside of the head and a mountain protruding toward the outside of the head, both with respect to a reference line of the swing.

The first folded portion may comprise:

the one mountain and the two valleys located on both sides of the mountain in the front-back direction of the head, and two first triangular elements whose length in a first direction which is the direction along the peripheral edge of the face is gradually increased from the mountain toward the respective valleys.

The second folded portion may comprise:

The one valley and the two mountains located on both sides of the valley in the front-back direction of the head, and two second triangular elements whose length in the above-said first direction is gradually decreased from the valley toward the respective mountains.

The second triangular element and the first triangular element may be continuous with each other by sharing one side with each other.

The first folded portion and the second folded portion may be repeatedly and alternately arranged in the first direction.

Each of the first triangular element and the second triangular element may be defined by straight sides.

The folded portion may have a structure including a diamond cut surface.

The folded portion may be formed so as to extend over the crown wall, the side wall and the sole wall.

According to another aspect of the present invention, a hollow golf club head comprise:

a face portion having a face for hitting a ball, and a main body portion including a crown wall, a side wall and a sole wall which walls extend from the face portion toward the rear of the head, wherein at least one of the crown wall, the side wall and the sole wall is provided with a folded portion for facilitating a partial deformation of the main body portion when the face portion hits a ball, and the folded portion comprises a diamond cut face.

Therefore, the golf club heads according to the present invention can increase the flight distance of a hit ball.

DESCRIPTION OF THE PREFERRED EMBODIMENTS

Figure 1:
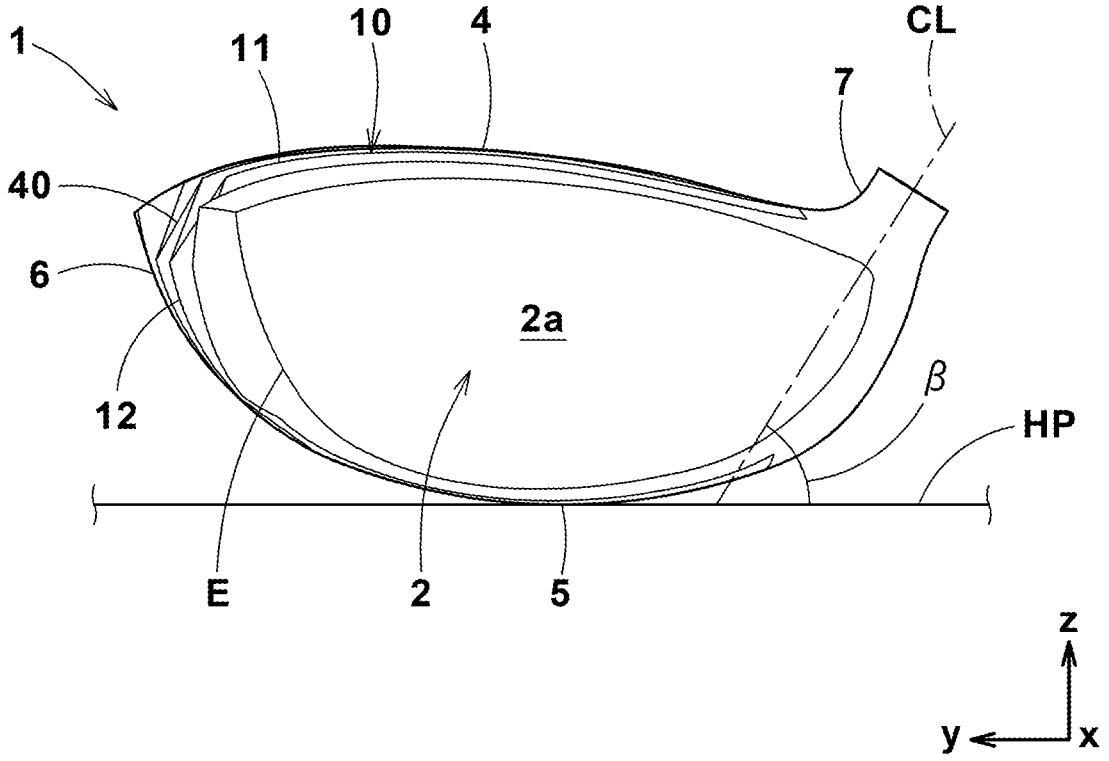
FIG. 1 is a front view of a golf club head as a first embodiment of the present invention.

Embodiments of the present invention will now be described in conjunction with accompanying drawings.

The embodiments described in detail below and the specific configurations shown in the drawings are only for understanding the present invention. The present invention is not limited to the specific configurations illustrated. Further, in the following description, it is to be noted that the same or common elements are denoted with the same reference numerals, and redundant description is omitted.

FIGS. 1 to 5 show a golf club head 1 as a first embodiment of the present invention (hereinafter simply referred to as the "head") under its reference state.

[Reference State of Head]

The reference state of the head 1 is such a state in which the head 1 is set on a horizontal plane HP at its loft angle α (FIG. 3) and lie angle β (FIG. 1) with respect to the horizontal plane HP, while locating a club shaft center line CL of the head 1 within a vertical plane VP.

The toe-heel direction of the head 1 means a horizontal direction y parallel with the vertical plane VP.

The front-back direction of the head means a horizontal direction x orthogonal to the vertical plane VP.

The up-down direction of the head means a vertical direction z orthogonal to both of the directions x and y.

[Basic Configuration of Head]

In the embodiment shown in FIGS. 1 to 5, the head 1 is provided therein with a hollow i (shown in FIG. 2), and the head 1 is formed as a typical wood type club head. And the head 1 in this example is for a driver.

Here, the wood-type club heads include at least driver (#1), a brassie (#2), a spoon (#3), a buffy (#4) and a creek (#5). In addition, the wood-type heads include a head having a shape similar to those listed above even if the number or designation/name are different from those listed above.

Further, the head 1 may be configured as a utility type or an iron type club head.

The head 1 of this embodiment is made of, for example, a metal material. As the metal material, various metal materials, e.g. titanium, titanium alloys, stainless steels, aluminum alloys and the like can be used.

Further, the head 1 may be partially made of a nonmetallic material, e.g. resin, rubber, elastomer, fiber reinforced resin and the like.

The head 1 in this embodiment is composed of a face portion 2 and a main body portion 3 extending from the face portion 2 toward the rear of the head.

The front surface of the face portion 2 defines a club face 2*a* for striking a ball. The face portion 2 is formed in a plate shape. The back surface (not shown) of the face portion 2 faces the hollow i.

The main body portion 3 comprises a crown wall 4, a sole wall 5 and a side wall 6 which are formed to surround the hollow The crown wall 4 extends from the face portion 2 so as to form the upper surface of the head. The sole wall 5 extends from the face portion 2 so as to form the bottom surface of the head. The side wall 6 extends between the crown wall 4 and the sole wall 5 and forms the side surface of the head. A toe side and a heel side of the side wall 6 are connected to a toe side and a heel side of the face portion 2, respectively.

The hollow i is located behind the face portion 2, and enclosed by the face portion 2, the crown wall 4, the sole wall 5 and the side wall 6.

Figure 2:
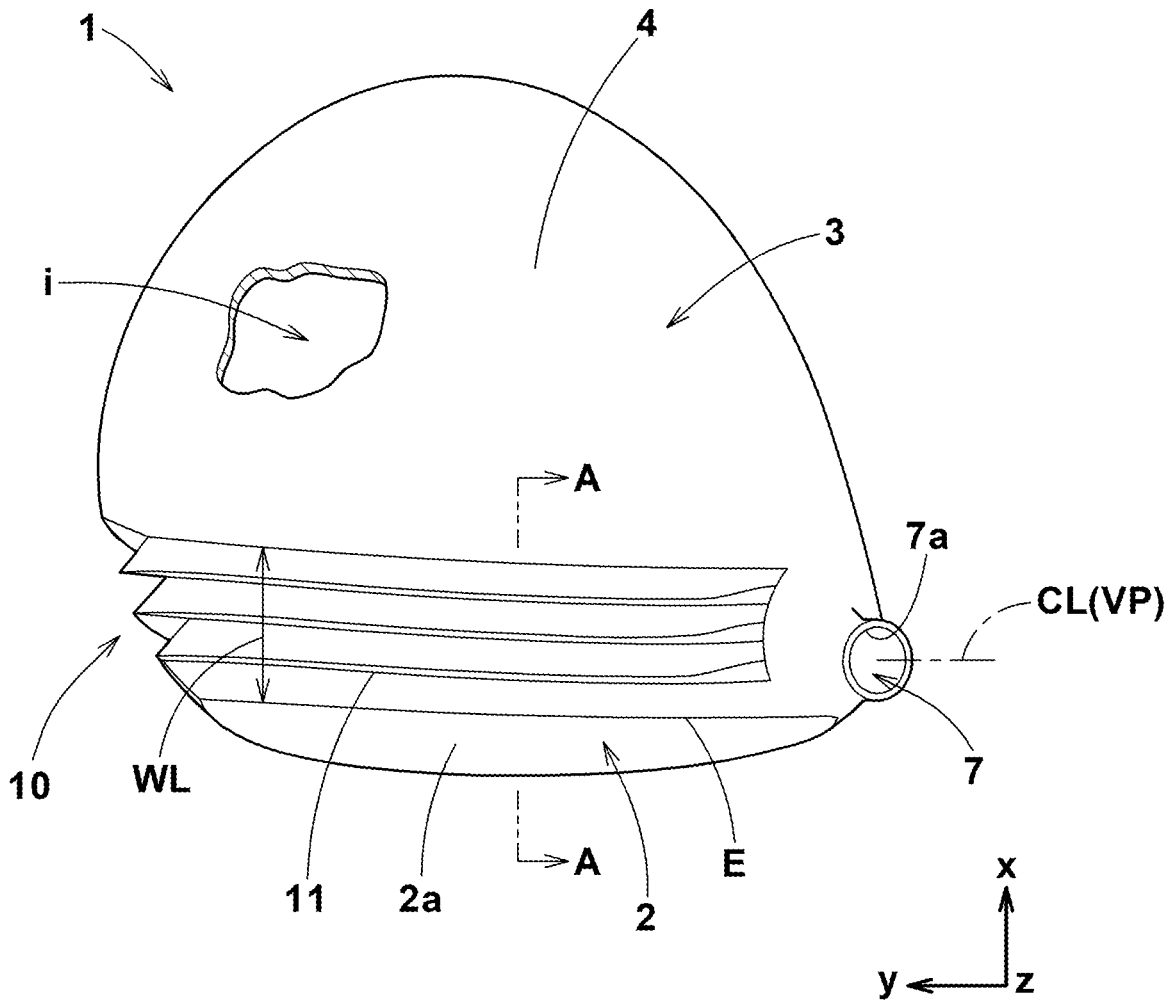
FIG. 2 is a top view of the golf club head shown in FIG. 1.

For example, in a heel side of the crown wall 4, a hosel portion 7 may be formed as shown in FIGS. 1 and 2.

For example, the hosel portion 7 is formed in a tubular shape having a shaft insertion hole 7*a* into which a club shaft (not shown) is attached. The center line of the shaft insertion hole 7*a* corresponds to the center line CL of the club shaft attached to the head.

[Folded Portion of First Embodiment]

In the head 1 in this embodiment, at least one of the crown wall 4, the sole wall 5 and the side wall 6 of the main body portion 3 is provided with a folded portion 10 as shown in FIGS. 1 and 2. The folded portion 10 functions to facilitate a partial elastic deformation of the main body portion 3 when the face portion 2 hits a ball.

Preferably, the folded portion 10 is formed so as to extend between at least two adjacent walls selected from the crown wall 4, the side wall 6 and the sole wall 5.

In this embodiment, the folded portion 10 extends from the crown wall 4 to the sole wall 5 through a toe side part of the side wall 6. Such folded portion 10 extending over the three walls 4, 5 and 6 like this is particularly preferred. But, it is also possible that the folded portion 10 is formed within only one of the crown wall 4, the side wall 6 and the sole wall 5.

The folded portion 10 includes a first folded portion 11 and a second folded portion 12.

[Configurations of First and Second Folded Portions]

Figure 3:
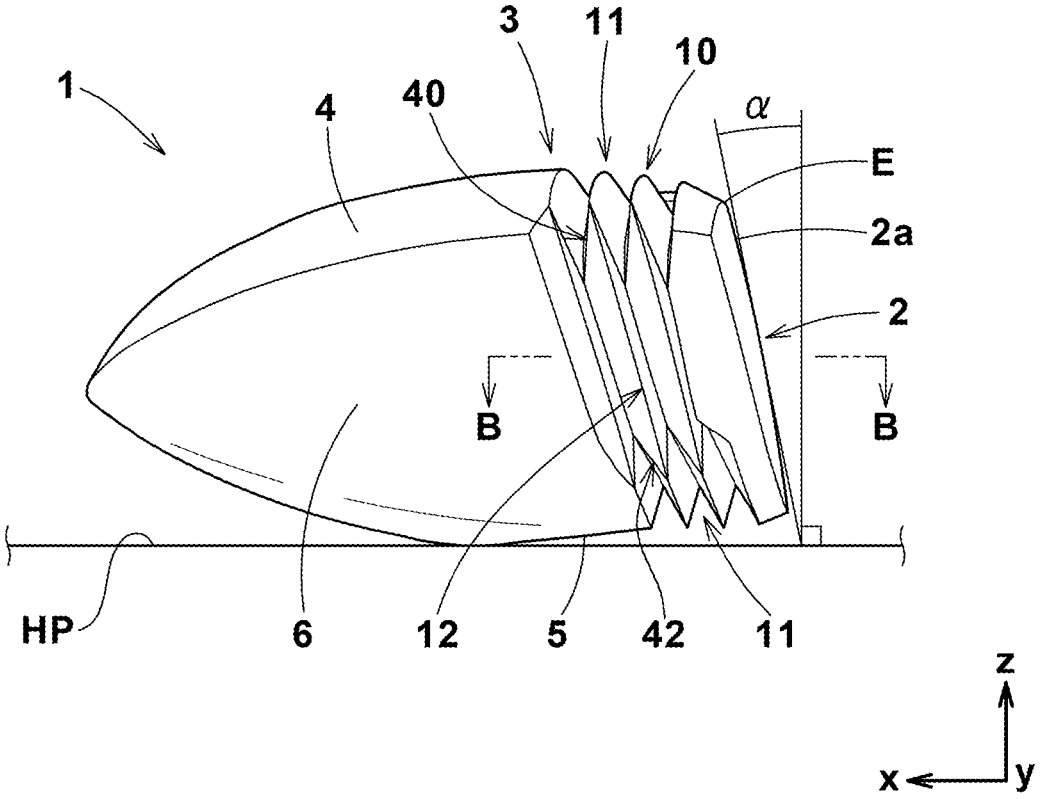
FIG. 3 is a side view of the golf club head shown in FIG. 1 as viewed from the toe side.
Figure 4:
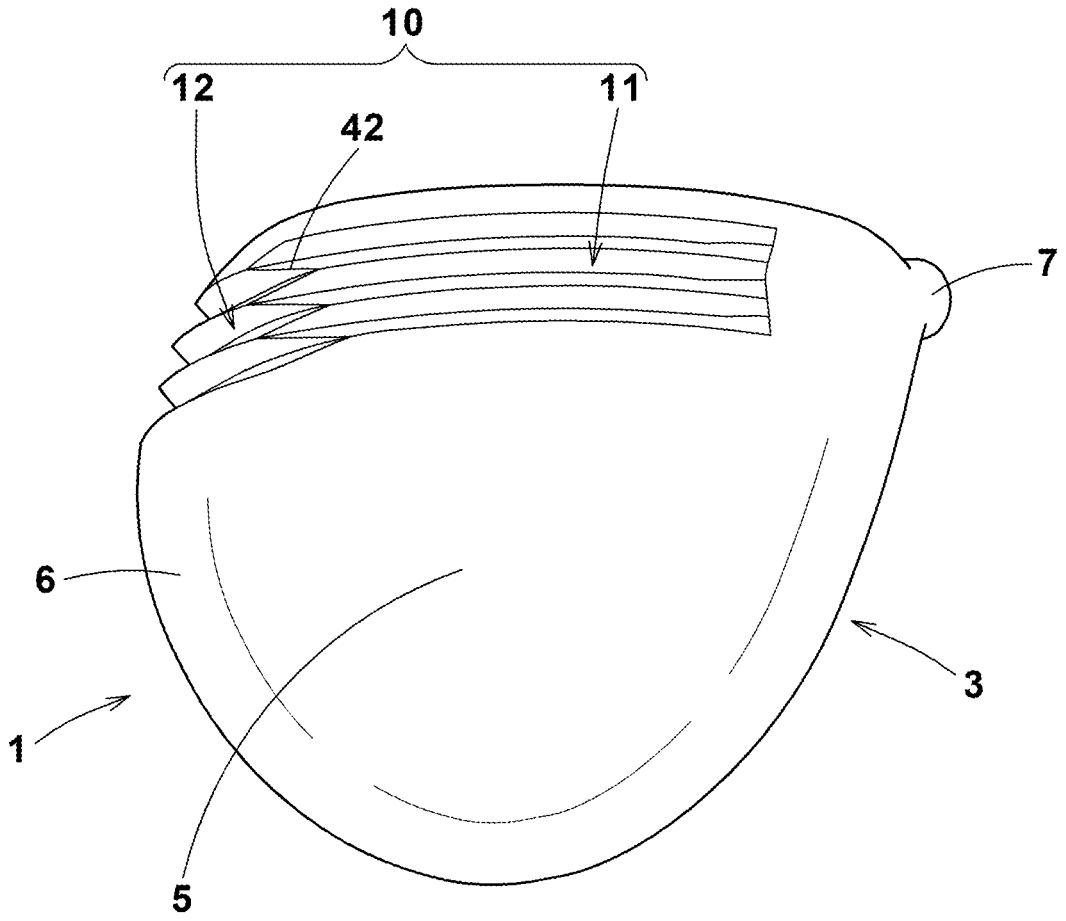
FIG. 4 is a bottom view of the golf club head shown in FIG. 1.
Figure 6A:
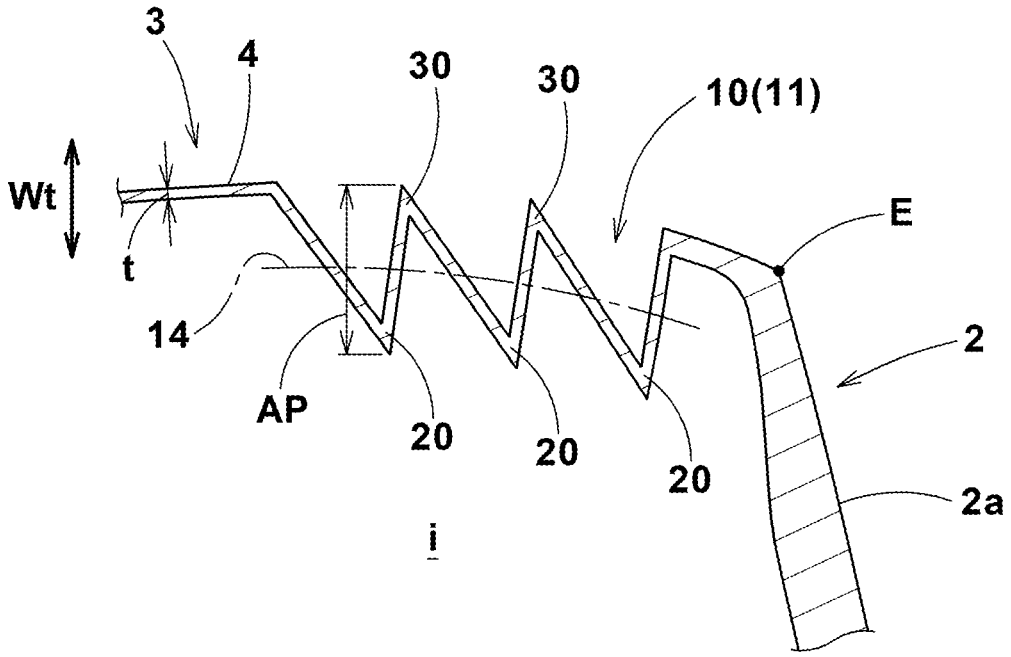
FIG. 6(A) is a cross-sectional view taken along line A-A of FIG. 2.
Figure 6B:
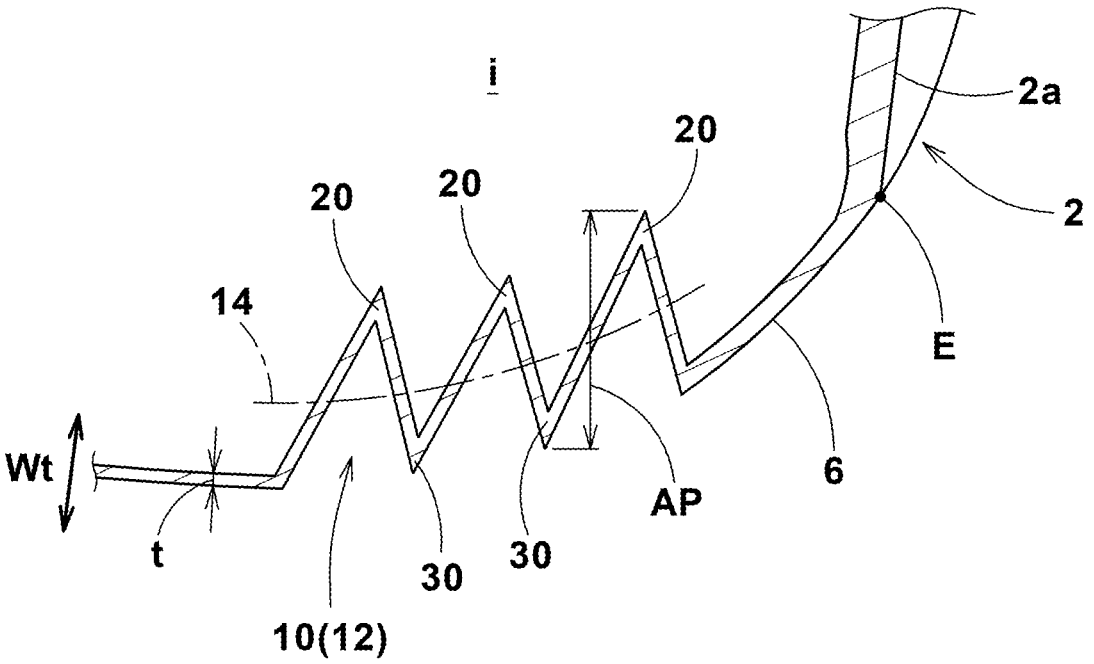
FIG. 6(B) is a cross-sectional view taken along line B-B of FIG. 3.

FIGS. 6(A) and 6(B) are cross-sectional views of the first folded portion 11 and the second folded portion 12 taken along line A-A of FIG. 2 and line B-B of FIG. 3, respectively, As shown, each of the first folded portion 11 and the second folded portion 12 has a folded structure extending in the front-back direction of the head while swinging in the thickness direction of the wall, namely, moving from the outside to the inside of the head.

Here, the "thickness direction of the wall" means, as shown by the symbol "wt" in FIGS. 6(A) and 6(B), the direction of the thickness of the wall (here, the crown wall 4 or side wall 6) in which the first folded portion 11 or second folded portion 12 is formed.

[Swing]

The "swing" means that, in the cross section as shown in FIGS. 6(A) and 6(B), the wall swings between one side and the other side in the thickness direction wt of a reference line 14 during the wall extends from the front side to the rear side.

The folded structure of this embodiment comprises a valley 20 recessed toward the inside of the head from the reference line 14, and a mountain 30 projecting toward the outside of the head from the reference line 14, and the valley 20 and the mountain 30 are arranged repeatedly and alternately in the front-back direction of the head.

As far as the mountain 30 projects toward the outside of the head from the reference line 14 of the swing, the mountain 30 may project or may not project toward the outside of the head from the surface of a portion other than the folded structure of the main body portion 3 (for example, the smooth surface of the crown wall).

As far as the valley 20 is recessed toward the inside of the head from the reference line 14 of the swing, the valley 20 may be recessed or may not be recessed toward the inside of the head from the surface of a portion other than the folded structure of the main body portion 3 (for example, the smooth surface of the crown wall).

In any way, in the folded portion 10, the wall is folded in a zigzag manner and extends in the front-back direction of the head.

In the figures (cross sections), the valleys 20 and the mountains 30 intersect at acute angles to have a zigzag line (that is, ridge lines and valley lines appear in the outer surface of the head).

However, the folded structure may be configured to have a curved line such as a wavy line, a sine curve and the like. In this case, no clear line may not appear in the outer surface of the head.

In the folded structure in this embodiment, the first folded portion 11 and the second folded portion 12 are continuous with each other, and extend along the peripheral edge E of the club face 2*a*.

Further, the phase of the swing of the first folded portion 11 is different from the phase of the swing of the second folded portion 12.

The folded portion 10 having such structure can effectively reduce the rigidity in the ball hitting direction. Therefore, when the face portion hits a ball, the main body portion 3 exhibits a large amount of partial elastic deformation, and the head 1 exhibits high rebound performance. As a result, the head 1 can increase the flight distance of the hit ball.

Further advantage of the folded portion 10 in this embodiment is that deformation when hitting a ball is less likely to be concentrated at a specific position in the longitudinal direction of the folded portion 10 (in the direction along the peripheral edge E of the club face 2*a*). Therefore, for example, even when a ball hits off the center of the club face 2*a*, the folded portion 10 can elastically deform in the ball hitting direction (the front-back direction) almost equally in the longitudinal direction. As a result, the direction of the club face 2*a* at the time of off-center hit is stabilized, and the directivity of the hit ball is improved.

[Peripheral Edge]

Figure 7A:
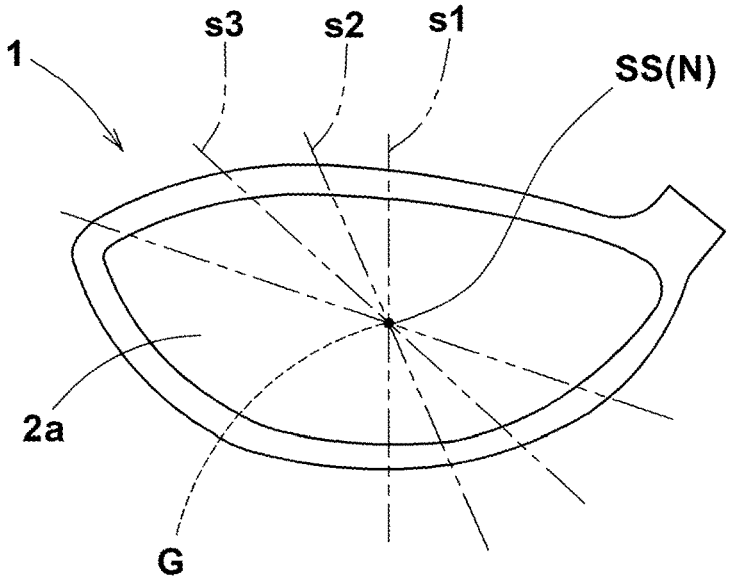
FIG. 7(A) and FIG. 7(B) are a front view of a golf club head and a cross-sectional view taken along s1 of FIG. 7(A) for explaining the peripheral edge of a club face.
Figure 7B:
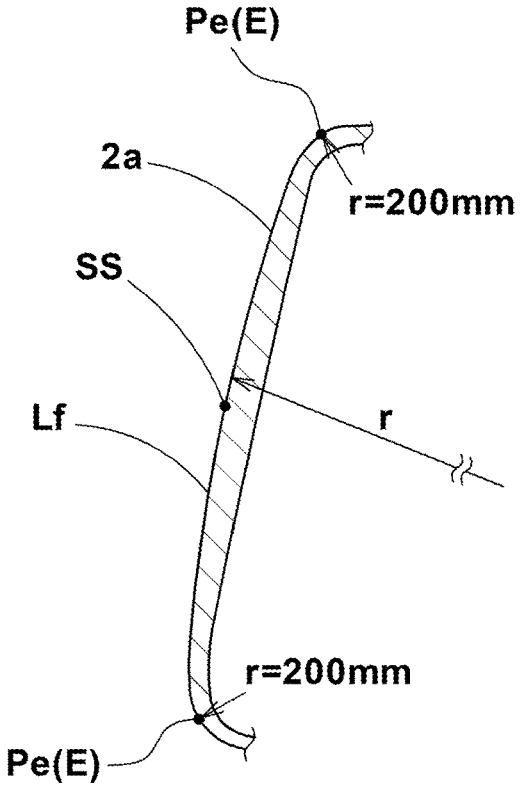
Figure 8:
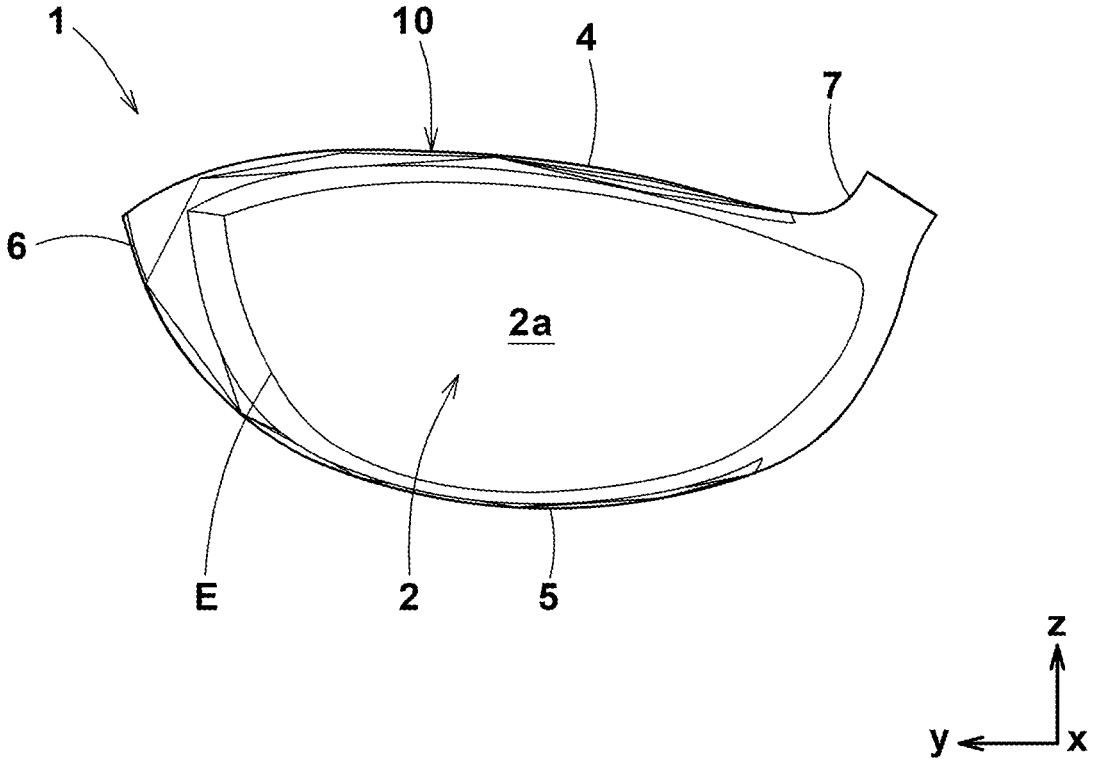
FIG. 8 is a front view of a golf club head a second embodiment of the according to the present invention.

In this invention, when the club face 2*a* is defined by a clear ridge line, the peripheral edge E of the club face 2*a* means the ridge line. However, when there is no clear ridge line, the peripheral edge E is determined as follows: in each cross section s1, s2, s3 . . . as shown in FIG. 7(A) which includes a normal line N to the club face 2*a* drawn from the gravity center G of the head to the sweet spot ss, a position Pe at which the radius r of curvature of the outer surface Lf of the club face 2*a* becomes 200 mm for the first time in the course from the sweet spot ss toward the outside of the club face 2*a* as shown in FIG. 7(B) is obtained, and an envelope curve passing the positions Pe obtained from the cross sections s1, s2, s3 . . . is determined. Then, the peripheral edge E of the club face 2*a* is defined by the envelope curve. Incidentally, the sweet spot ss is a point of intersection of the club face 2*a* and the normal line N.

Figure 5:
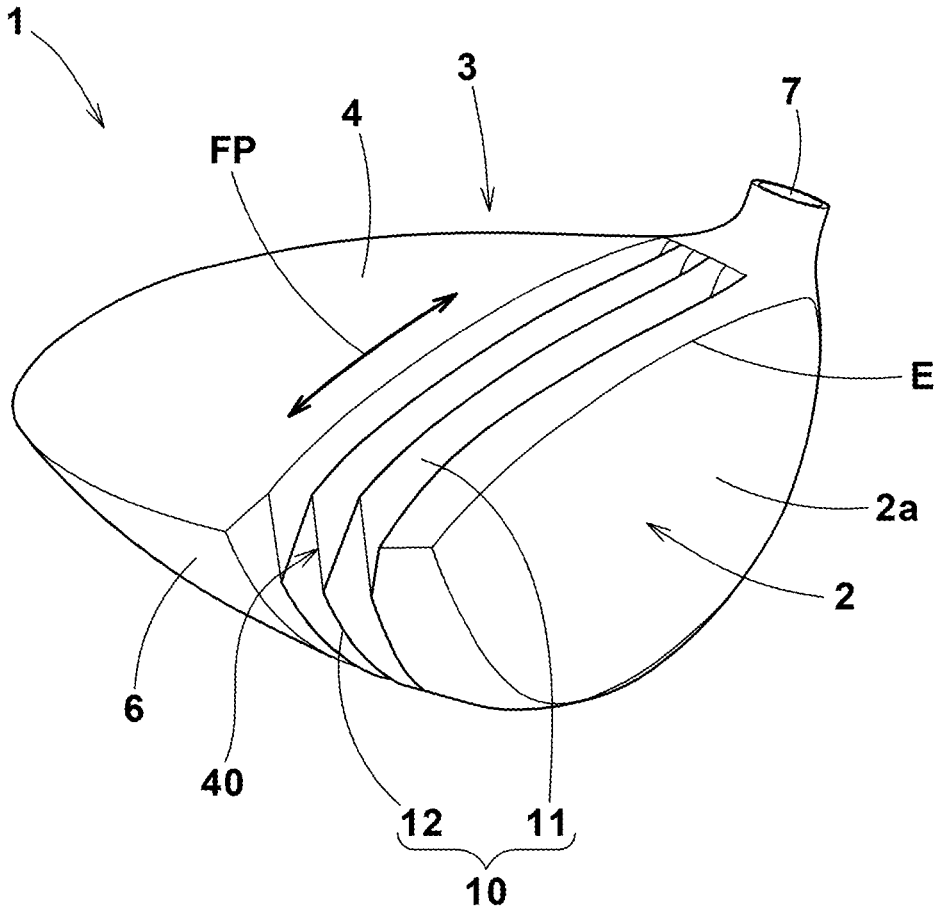
FIG. 5 is a perspective view of the golf club head shown in FIG. 1.

Hereafter, the direction FP along the peripheral edge E as shown in FIG. 5 is referred to as the "1st direction". Here, the expression "along the peripheral edge E" does not require to be completely parallel with the peripheral edge E.

It is preferable that the difference in the above-said phase between the first folded portion 11 and the second folded portion 12 is a half cycle. More specifically, the first folded portion 11 and the second folded portion 12 are preferably arranged such that each mountain 30 of the first folded portion 11 is continuous with one of the valleys 20 of the second folded portion 12, and each valley 20 of the first folded portion 11 is continuous with one of the mountains 30 of the second folded portion 12.

It is preferable that the junction 40 at which the first folded portion 11 is connected to the second folded portion 12 is formed at a position corresponding to the boundary between the two walls of the main body portion 3.

In the folded portion 10 in this embodiment, the first folded portion 11 is formed in the crown wall 4 and the second folded portion 12 is formed in the side wall 6, and the junction 40 therebetween is formed along the border between the crown wall 4 and the side wall 6.

In this embodiment, a further first folded portion 11 is formed in the sole wall 5, and a junction 42 at which the further first folded portion 11 and the above-said second folded portion 12 are connected to each other is formed along the border between the sole wall 5 and the side wall 6.

The junctions 40 and 42 are each configured by a mountain fold which extends in the front-back direction of the head in a zigzag shape while connecting the respective mountains 30 between the first folded portion 11 and the second folded portion 12. The mountain fold is a portion which is bent so as to protrude outward of the head.

Such junctions 40 and 42 can smoothly connect between the first folded portion 11 and the second folded portion 12 which are formed in the different walls having the different phases.

At the time of off-center shot, for example, where the ball hits a toe side of the club face 2*a*, the elastic deformation in the front-back direction of the head occurring more directly in the second folded portion 12 in the side wall 6 can be transmitted smoothly through the junctions 40 and 42 to the first folded portion 11 in the crown wall 4 and/or the first folded portion 11 in the sole wall 5. This facilitates elastic deformation of the first folded portions 11 in the crown wall 4 and the sole wall 5. Therefore, the junctions 40 and 42 in this embodiment can cause elastic deformation which is more uniform in the longitudinal direction of the folded portion 10 even if the club face 2*a* makes off-center shot, and the directionality of the hit ball can be improved.

The thickness t of each of the crown wall 4, the sole wall 5 and the side wall 6 (inclusive of the folded portion 10) can be variously set according to the conventional practice, and is not to be particularly limited.

For example, preferably, the thickness t of each of the walls 4 to 6 may be set in a range from 0.5 to 3.5 mm.

As shown in FIG. 2, the width WL in the front-back direction of the head of the folded portion 10 is not to be particularly limited. But, in order to provide a sufficient deformation area in the main body portion 3, it is preferred that the width WL is 10 mm or more, more preferably 20 mm or more.

The folded structure of each of the first folded portion 11 and the second folded portion 12 includes at least one cycle made up of one valley 20 and one mountain 30.

In order that the main body portion 3 is provided with a sufficient deformation area, it is preferable for each folded structure to include 1.5 cycles or more, more preferably 2 cycles or more.

In the folded structure of the first folded portion 11 and the folded structure of the second folded portion 12, the peak-to-peak amplitude AP of the swing from the valley 20 to the mountain 30 in the cross section as shown in FIGS. 6(A) and 6(B), is not to be particularly limited. But, in order to provide a sufficient deformation area for the main body portion 3, it is preferred that the amplitude AP is set to be not less than 1.5 times, more preferably not less than 2.0 times the thickness t of the wall provided with the folded portion concerned.

[Folded Portion of Second Embodiment]

Next, a golf club head 1 as a second embodiment of the present invention will be described in conjunction with FIGS. 8 to 13. The difference of the head 1 of the second embodiment from the first embodiment is only the configuration of the folded portion 10.

Figure 9:
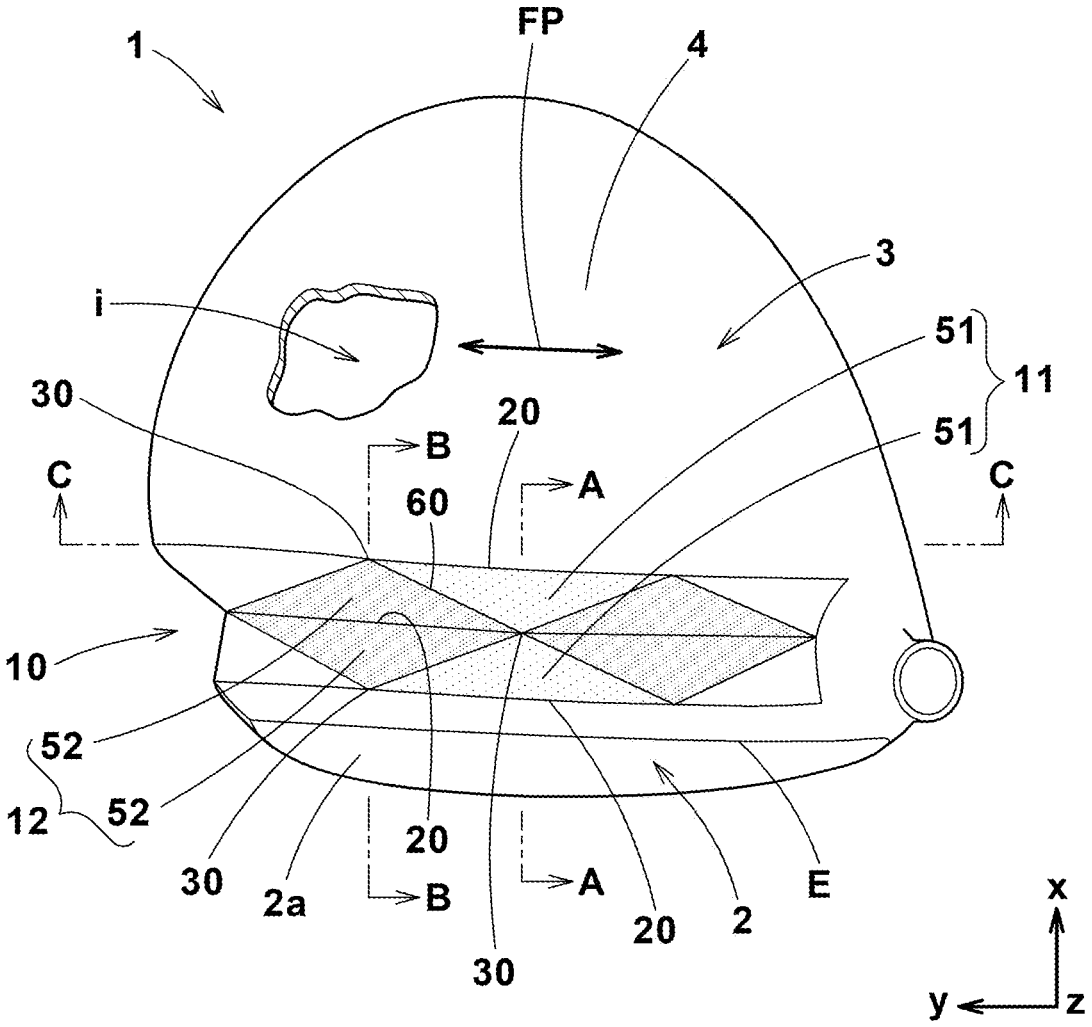
FIG. 9 is a plan view of the golf club head shown in FIG. 8.
Figure 13A:
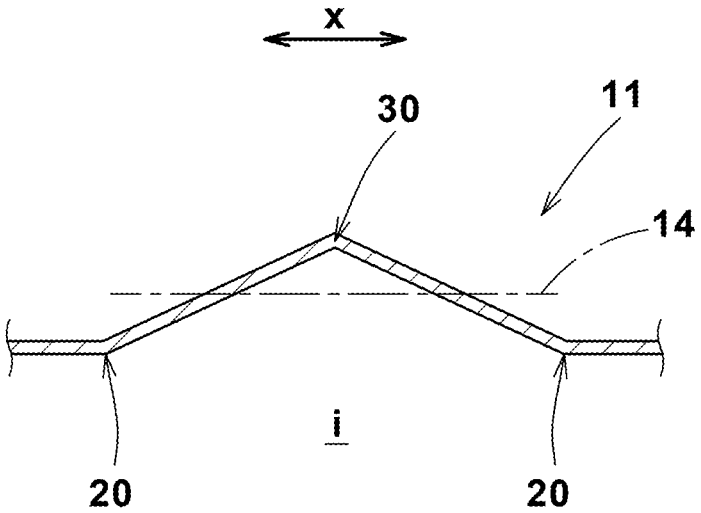
FIG. 13(A) is a cross-sectional view taken along line A-A of FIG. 9.
Figure 13B:
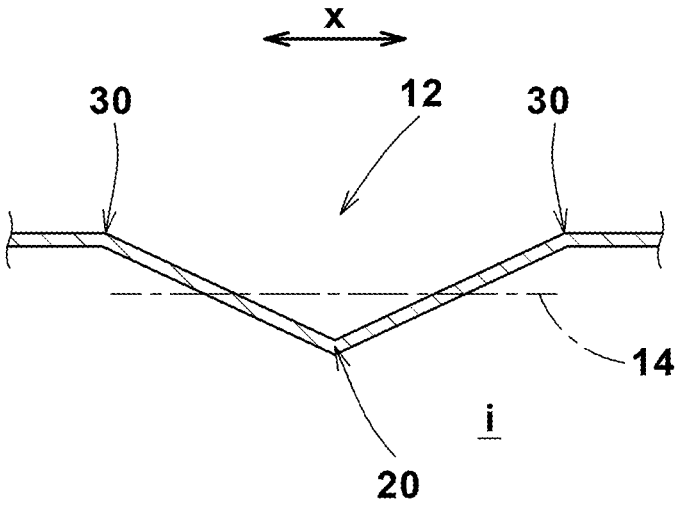
FIG. 13(B) is a cross-sectional view taken along line B-B of FIG. 9.

FIGS. 13(A) and 13(B) are cross-sectional views taken along line A-A and line B-B of FIG. 9 which show the first folded portion 11 and the second folded portion 12, respectively.

As shown, in the second embodiment too, each of the first folded portion 11 and the second folded portion 12 comprises a valley 20 recessed toward the inside of the head from the reference line 14 of the swing, and a mountain 30 projecting toward the outside of the head from the reference line 14.

As shown in FIG. 13(A), the first folded portion 11 comprises one mountain 30 and two valleys 20 positioned on both sides of the mountain in the front-back direction x of the head 1. Further, as shown in FIG. 9, the first folded portion 11 comprises two first triangular elements 51, wherein the length in the first direction FP of each first triangular element 51 is gradually increased from the mountain 30 to the valley 20. In this embodiment, the two first triangular elements 51 constituting the first folded portion 11 are substantially isosceles triangles of substantially the same shape, and the apexes thereof are connected to each other as shown in FIG. 9.

As shown in FIG. 13(B), the second folded portion 12 comprises one valley 20 and two mountains 30 located on both sides of the valley in the front-back direction x of the head. Further, as shown in FIG. 9, the second folded portion 12 comprises two second triangular elements 52, wherein the length in the first direction FP of each second triangular element 52 is gradually decreased from the valley 20 to the mountain 30. In this embodiment, the two second triangular elements 52 constituting the second folded portion 12 are substantially isosceles triangles of substantially the same shape, and the bases thereof are connected to each other. In other words, one side is shared with each other.

Preferably, the first triangular element 51 and the second triangular element 52 are each defined by straight sides 60.

Preferably, the first triangular element 51 and the second triangular element 52 are each formed as being flat in the outer surface of the head.

Such configuration helps to make the folded portion 10 more flexible when hit a ball.

The second triangular element 52 and the first triangular element 51 are connected to each other by sharing the sides 60 with each other. Those sides 60 constitute a junction 44 between the first folded portion 11 and the second folded portion 12 which portions are different from each other in the phase of the swig by a half cycle.

Such a folded portion 10 of the second embodiment is called as a diamond cut surface.

In this embodiment, the first folded portion 11 and the second folded portion 12 are arranged repeatedly and alternately in the first direction FP.

Figure 10:
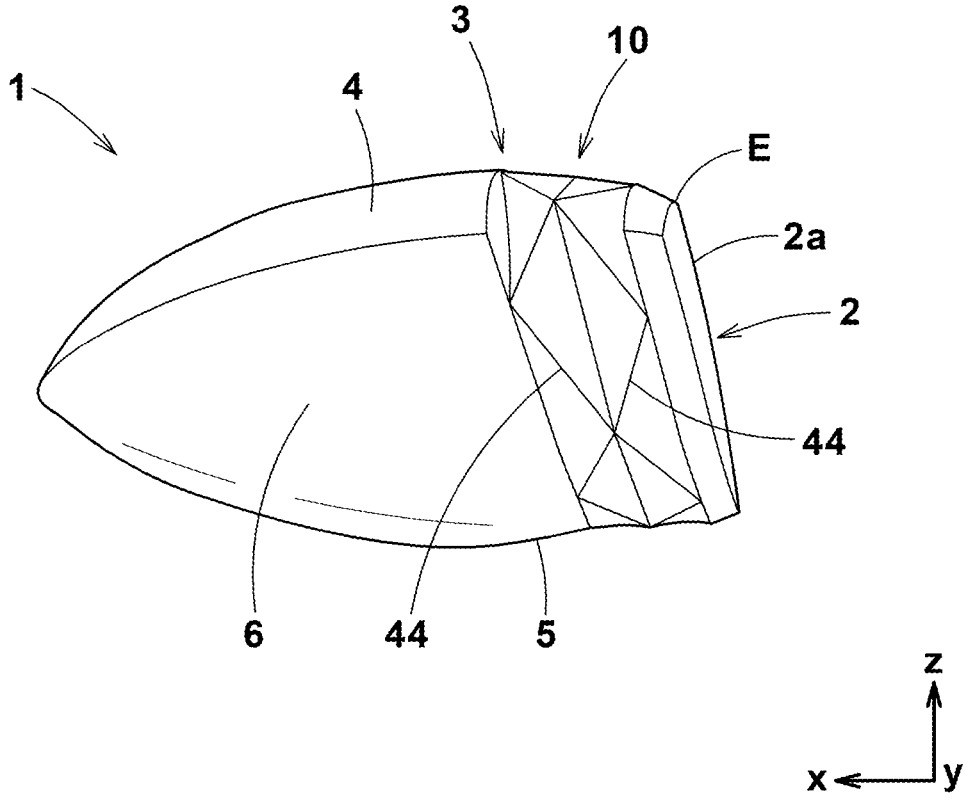
FIG. 10 is a side view of the golf club head shown in FIG. 8 as viewed from the toe side.
Figure 11:
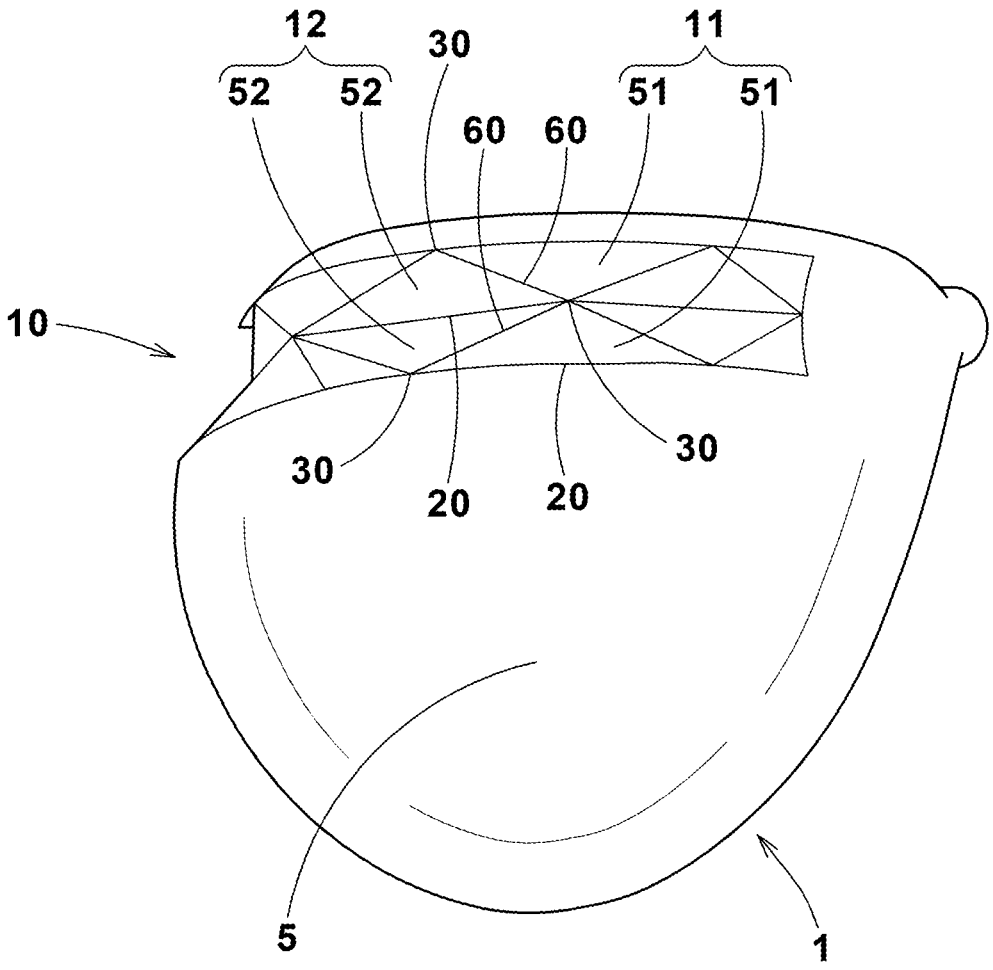
FIG. 11 is a bottom view of the golf club head shown in FIG. 8.
Figure 12:
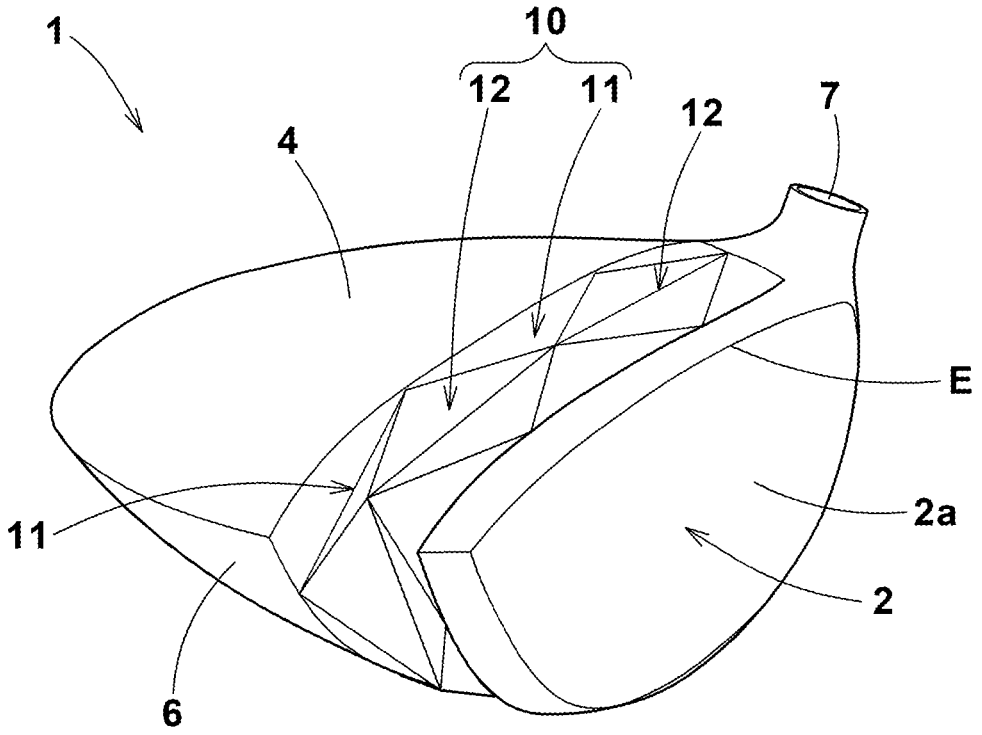
FIG. 12 is a perspective view of the golf club head shown in FIG. 8.

In this example, as shown in FIG. 9, the crown wall 4 includes the first folded portion 11 and the second folded portion 12. Further, as shown in FIG. 10 and FIG. 11, each of the side wall 6 and the sole wall 5 includes the first folded portion 11 and the second folded portion 12.

Thus, in this example of the second embodiment, each of the three walls 4 to 6 of the main body portion 3 includes both of the first folded portion 11 and the second folded portion 12.

Figure 14:
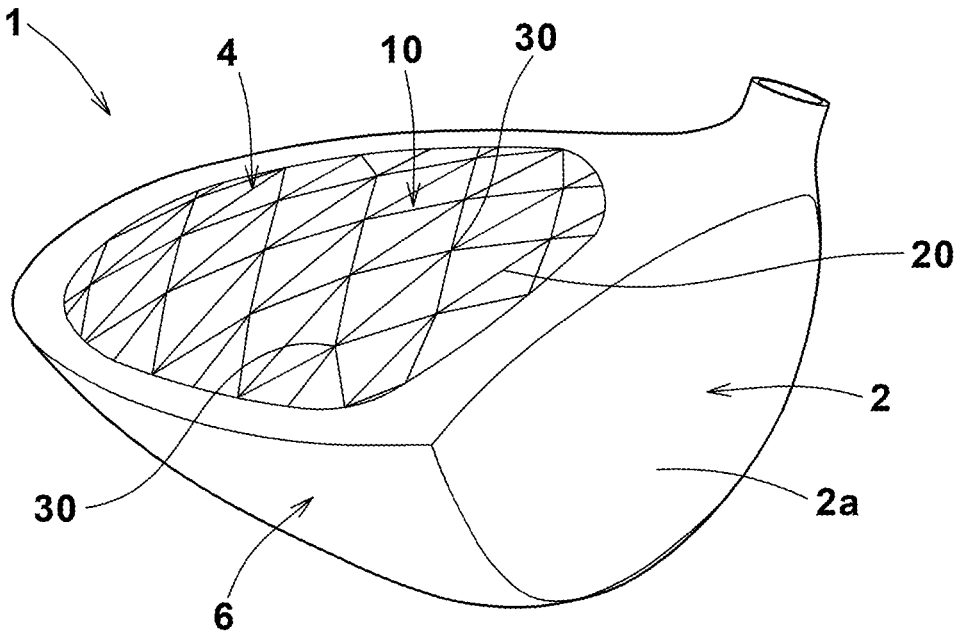
FIG. 14 is a perspective view of a golf club head as a further embodiment of the present invention.

As another example of the second embodiment, only one of the crown wall 4, the side wall 6 and the sole wall 5 may be provided with the diamond cut surface. FIG. 14 shows such example. In this example, more mountains 30 and valleys 20 can be formed in the front-back direction of the head.

While detailed description has been made of preferable embodiments of the present invention, the present invention can be embodied in various forms without being limited to the illustrated embodiments.

It is to be noted that, in this description, it is intended that an element and its variants described in an embodiment are applicable to a corresponding element of another embodiment, even if not explicitly stated.

Comparison Test

In order to confirm the effects of the present invention, a plurality of hollow titanium alloy golf club heads were designed, and then using their FEM models, the rebound performance of each head was obtained through a computer simulation.

All of the heads had the same specifications except for the folded portions. The specifications of each head are as follows.

Comparative Example 1 is a golf club head not provided with a folded portion.

Figure 15:
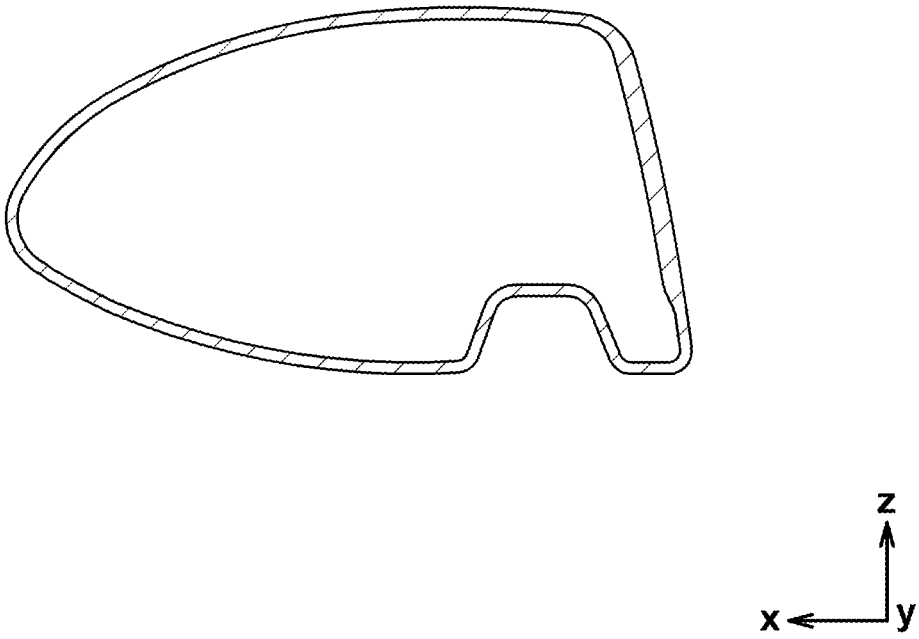
FIG. 15 is a cross-sectional view of a golf club head as a comparative example 2.

Comparative Example 2 is a golf club head provided in the sole wall with a groove extending in the toe-heel direction as shown in FIG. 15.

Example 1 is a golf club head provided with the folded portion shown in FIGS. 1-6.

Example 2 is a golf club head provided with the folded portion (diamond cut surface type) shown in FIGS. 8-13.

The rebound performance of each head was evaluated by the coefficient of restitution (COR) of the head.

In reference to the test procedure of the U.S.G.A., the velocities of a ball before and after collision were calculated by colliding the ball with the center of the club face at a predetermined velocity, and then the velocity ratio was obtained as the coefficient of restitution (OCR).

The results are indicated in Table 1 by an index base on Comparative Example 2 being 100, wherein the larger the value, the better the rebound performance.

TABLE 1

| Head | Comparative Example 1 | Comparative Example 2 | Example 1 | Example 2 |
|---|---|---|---|---|
| OCR | 98 | 100 | 104 | 102 |

From the test results, it was confirmed that, as compared with the coefficient of restitution of comparative Example 1, although the improvement of comparative Example 2 was only 2.0%, Example 1 was improved by 6.1% and Example 2 was improved by 4.1%.

DESCRIPTION OF THE REFERENCE SIGNS

1 golf club head
2 face portion
2*a* club face
3 main body portion
4 crown wall
5 sole wall
6 side wall
10 folded portion
11 first folded portion
12 second folded portion
14 reference line
20 valley
30 mountain
40 junction
42 junction
44 junction
51 first triangular element
52 second triangular element
60 one side
E peripheral edge
FP first direction
i hollow

The invention claimed is:

1. A hollow golf club head comprising:
a face portion having a face for striking a ball; and
a main body portion including a crown wall, a side wall and a sole wall which extend from the face portion toward the rear of the head,
wherein
at least one wall of the crown wall, the side wall and the sole wall is provided with a folded portion for facilitating a partial elastic deformation of the main body portion when the face portion hits a ball,
the folded portion includes a first folded portion and a second folded portion,
in the first folded portion, the wall constituting the first folded portion has a pleated-shape extending in a front-back direction of the head so that the first folded portion comprises valleys recessed toward the inside of the head and mountains projecting toward the outside of the head which are alternately arranged in the front-back direction of the head, and
in the second folded portion, the wall constituting the second folded portion has a pleated-shape extending in the front-back direction of the head so that the second folded portion comprises valleys recessed toward the inside of the head and mountains projecting toward the outside of the head which are alternately arranged in the front-back direction of the head,
the first folded portion and the second folded portion extend along a peripheral edge of the face portion, and connected with each other at a junction, and
at the junction, the arrangement of the valleys and the mountains of the first folded portion is the same as the arrangement of the valleys and the mountains of the second folded portion, but shifted therefrom in the front-back direction of the head, so that the junction has a mountain extending pleat in the front-back direction of the head while connecting between the respective mountains of the first folded portion and the second folded portion.

2. The golf club head according to claim 1, wherein
the folded portion is formed so as to extend across at least two adjacent walls of the crown wall, the side wall and the sole wall, and
the junction is formed at a position corresponding to that of the boundary between the two adjacent walls.

3. A hollow golf club head comprising:
a face portion having a face for striking a ball; and
a main body portion including a crown wall, a side wall and a sole wall which extend from the face portion toward the rear of the head,
wherein
at least one wall of the crown wall, the side wall and the sole wall is provided with a folded portion for facilitating a partial elastic deformation of the main body portion when the face portion hits a ball,
the folded portion includes a first folded portion and a second folded portion, and
the first folded portion and the second folded portion extend along a peripheral edge of the face portion, and are connected with each other at a junction,
each of the first folded portion and the second folded portion extends in a front-back direction of the head to have a mountain protruding toward the outer side of the head and a valley recessed toward the inside of the head,
the first folded portion is made up of the mountain and the two valleys located on both sides of the mountain in the front-back direction of the head, and
two side faces between the mountain and the two valleys are respectively formed by two first triangular elements whose length in a first direction which is the direction along the peripheral edge of the face is gradually increased from the mountain toward the respective valleys,
the second folded portion is made up of the valley and the two mountains located on both sides of the valley in the front-back direction of the head, and
two side faces between the valley and the two mountains are respectively formed by two second triangular elements whose length in the above-said first direction is gradually decreased from the valley toward the respective mountains, and
at the junction between the first folded portion and the second folded portion, the two first triangular elements of the first folded portion are respectively connected with the two second triangular elements of the second folded portion by sharing one of three sides of triangle.

4. The golf club head according to claim 3, wherein
the first folded portion and the second folded portion are repeatedly and alternately arranged in the first direction.

5. The golf club head according to claim 1, wherein
the folded portion is formed so as to extend over the crown wall, the side wall and the sole wall.

6. The golf club head according to claim 3, wherein
each of the first triangular element and the second triangular element is defined by straight sides.

7. The golf club head according to claim 3, wherein the folded portion is formed so as to extend over the crown wall, the side wall and the sole wall.

8. A hollow golf club head comprising:

a face portion having a face for hitting a ball, and a main body portion including a crown wall, a side wall and a sole wall which walls extend from the face portion toward the rear of the head, wherein at least one of the crown wall, the side wall and the sole wall is provided with a folded portion for facilitating a partial deformation of the main body portion when the face portion hits a ball, the folded portion includes a first folded portion and a second folded portion, in the first folded portion, the wall constituting the first folded portion has alternating valleys and mountains extending in a front-back direction of the head such that the valleys are recessed toward the inside of the head and the mountains project toward the outside of the head, and in the second folded portion, the wall constituting the second folded portion has alternating valleys and mountains extending in the front-back direction of the head such that the valleys are recessed toward the inside of the head and the mountains project toward the outside of the head, in the first folded portion, side faces between the mountains and the valleys are each formed by a first triangular element whose length in a first direction which is the direction along a peripheral edge of the face is gradually increased from the mountain toward the valley, and in the second folded portion, side faces between the valleys and the mountains are each formed by a second triangular element whose length in the above-said first direction is gradually decreased from the valley toward the mountain, the first folded portion and the second folded portion are repeatedly and alternately arranged along a peripheral edge of the face portion, and are connected with each other at a junction, and at the junction, the first triangular elements of the first folded portion are respectively connected with the second triangular elements of the second folded portion by sharing one of three sides of triangle, whereby the folded portion has an outer surface formed by a diamond-cut face made up of triangular surfaces.

* * * * *